US005731656A

United States Patent [19]

Greiler et al.

[11] Patent Number: 5,731,656

[45] Date of Patent: Mar. 24, 1998

[54] DOUBLE-BASED LAMP AND SOCKET THEREFOR, AND LAMP BASE CONSTRUCTION

[75] Inventors: Wolfgang Greiler, Unterhaching; Michael Pleuser, Graefelfing, both of Germany

[73] Assignee: Patent-Treuhand-Gesellschaft F. Elektrische Gluehlampen mbH, Munich, Germany

[21] Appl. No.: 643,475

[22] Filed: May 6, 1996

[30] Foreign Application Priority Data

May 12, 1995 [DE] Germany ..... 195 17 516.6

[51] Int. Cl.[6] ..... H01K 1/24; H01J 61/84; H01R 33/00

[52] U.S. Cl. ..... 313/318.01; 313/318.02; 313/318.03; 439/612

[58] Field of Search ..... 313/318.01, 318.02, 313/318.03, 318.07, 318.09, 318.1, 578, 567, 569, 580, 624, 634, 493; 439/220, 602, 611, 612, 613, 619, 702

[56] References Cited

U.S. PATENT DOCUMENTS

| | | | |
|---|---|---|---|
| 4,949,007 | 8/1990 | Takagi et al. | 313/318.02 |
| 4,952,838 | 8/1990 | DuNah | 313/318.02 |
| 5,130,604 | 7/1992 | Franks, Jr. et al. | 313/318.03 X |
| 5,264,760 | 11/1993 | Genz et al. | 313/641 |
| 5,276,379 | 1/1994 | Harden et al. | 313/318.02 X |
| 5,296,780 | 3/1994 | Harden et al. | 313/318.02 X |
| 5,382,874 | 1/1995 | Johnson | 313/578 |

FOREIGN PATENT DOCUMENTS

| | | |
|---|---|---|
| 29 17 745 | 11/1980 | Germany . |
| 39 34 348 A1 | 4/1991 | Germany . |
| 295 04 517.5 U1 | 6/1995 | Germany . |

*Primary Examiner*—Ashok Patel

*Attorney, Agent, or Firm*—Frishauf, Holtz, Goodman, Langer & Chick, P.C.

[57] ABSTRACT

To insure that lamps which have a non-rotation symmetrical feature or structure with respect to aligned bases (e.g., a tipped-off exhaust or pumping stub) are placed in a predetermined preferred operating position when inserted into socket terminals (2a, 2b), the lamp bases are formed with stepped surface abnormalities (10a, 10b), for example, in the form of recesses or projections from a terminal engagement surface (8a, 8b) extending perpendicularly to the lamp axis (A—A); socket springs (2a, 2b) have matching surface abnormalities which interengage with the surface abnormality on the base, for example by being formed with ridges, or depressions. The lamp thus can be inserted in such bases only if the respective surface abnormalities on the lamp bases and in the socket terminals can engage. The lamp, however, can be used also with socket terminals which do not have such interengagement surface abnormalities, so that the lamps are universally usable with specific location-determining sockets, or with sockets where the position of the lamp must be determined by a user.

21 Claims, 3 Drawing Sheets

DOUBLE-BASED LAMP AND SOCKET THEREFOR, AND LAMP BASE CONSTRUCTION

Reference to related patent, the disclosure of which is hereby incorporated by reference, assigned to the assignee of the present application:

U.S. Pat. No. 5,264,760, Genz et al.

1. Field of the Invention

The present invention relates to a double-based electric lamp, having a preferred operating position, a lamp base construction and a socket for the lamp, so that, with an appropriate socket, the lamp can be placed in the socket in only its preferred position.

2. Background

Lamps which are not entirely rotation symmetrical, for example by being formed with a pump stub or exhaust stub at a side thereof, when used in optical apparatus, require that the lamp is located in the apparatus in a preferred position so that the dissymmetry of the lamp will not cause undesired optical effects. Such lamps may be double based and are usually retained in a suitable socket in the optical apparatus. The lamps are typically high-pressure discharge lamps. The sockets are integrated, usually, in a projection apparatus, or in a reflector housing. The already double-based high-pressure discharge lamps have a discharge bulb with two ends having the bases located thereon, positioned diametrically along a longitudinal axis of the lamp bulb. The ends of the lamp bulb, particularly within the region of the base, are essentially rotational symmetrical with respect to the longitudinal axis of the lamp bulb. The lamp bulb itself, however, is not rotation symmetrical, and located in the optical apparatus in a predetermined well-defined operating position. The referenced Genz et al U.S. Pat. No. 5,264,760 discloses an example of such a lamp.

Usually, the rotation symmetry of the lamp with respect to its longitudinal axis is destroyed by a pumping stub, located for example centrally of the lamp bulb, in a wall thereof. This pumping stub forms a radial asymmetry. When such a lamp is inserted in an optical apparatus, for example a projection apparatus, or into a reflector luminaire or in a reflector housing, it is necessary to carefully position the lamp in such a manner that the pumping stub does not interfere with the optical imaging of the light source from the lamp. This requires that the lamp, inserted in its appropriate socket, is rotated into its preferred operating position, so that it will be appropriately sighted within the optical apparatus, and the pumping stub will be located in a position which is not required for the optical imaging of the lamp. Sockets for the customary commercial double-based electric lamps do not have any positioning arrangements which insure that the lamp can only be inserted in its preferred operating position, which is a substantial disadvantage of the present commercial double-based lamps. The rotation-symmetrical structure of the ends of the bulb in the region of the bases thereof, and particularly the base sleeves at the ends thereof, and the sockets which receive the base sleeves, permit locating the lamp within the optical apparatus at any random rotary position. Thus, a user which uses these lamps and sockets must first study, and review instructions for use to learn how the lamp is to be appropriately placed, and then must take care to locate the lamp within the apparatus in accordance with the directions of use, so that the pump stub will be in the position which the instructions require. If the user is not careful, or has difficulty in installation, the optical imaging of the light source may be poor and, in a worse condition case, may lead to destruction of the lamp.

THE INVENTION

It is an object to insure appropriate placement of a lamp in an optical apparatus which requires a preferred position for the lamp, and more particularly to a double-based lamp, a lamp base construction for the lamp and a lamp socket, all of which, separately or together, insure that a lamp can be placed in the appropriate socket, only in a preferred specific arranged alignment, or position, that means, in its preferred operating position; and in which the socket can be readily placed in an optical apparatus, in which the lamp then can be located. The lamp bases, additionally, should be so arranged that the lamp can also be used in optical apparatus which have sockets accepting any lamp, and which are not specifically adapted to place the lamp in a preferred operating position, so that the double-based lamp can be used, universally, as a replacement element in any optical apparatus designed for its rating.

Briefly, at least one, and preferably both of the lamp bases of the double-based lamp are provided with a specific arrangement or means to determine a preferred operating position of the lamp to which the bases are connected. Such a preferred operating position determining arrangement may, for example, be a surface abnormality which is formed on at least one of the bases and located non-rotation symmetrically on a portion of the base, which, except for the abnormality, is otherwise rotation symmetrical.

"Surface abnormality", as used herein, refers to a region or portion of the base to render it non-rotation symmetrical and, for example, and typically, is either a flattened surface, recessed, for example, from an otherwise rotation-symmetrical sleeve, a raised portion on the rotation-symmetrical sleeve, or the like, in short, a surface configuration which destroys the rotational symmetry of a rotation-symmetrical base, or base portion.

In accordance with a preferred feature of the invention, the bases for a double-based electrical lamp are formed with engagement surfaces extending essentially perpendicularly with respect to a longitudinal lamp axis. The engagement surface is formed with a surface abnormality in form of a recess, or a raised region or a rise, which destroys the rotational symmetry of the ends of the lamp bulb.

In accordance with a feature of the invention, contacts, or contact elements forming part of the socket with which the lamp is to be used, are arranged to clamp against the engagement surfaces, and are, additionally, formed with respective rises or projecting portions, or recesses, depressions or notches which match the surface abnormality of the lamp base and, when engaged with a lamp base, form an interfitting seating arrangement. The depressions or rises, respectively, in the engagement surfaces, or the rises and depressions, respectively, in the terminals of the socket, form a positioning arrangement for the lamp, ensuring that the lamp can be properly seated in the socket only when inserted in the preferred location. Upon fitting the ends of the lamp bulb in the appropriate sockets, the depression or rise in the engagement surfaces of the bases, and the rises or projections, or depressions, respectively, on the socket terminals form guide elements to insure properly placed seating of the lamp.

Preferably, the ends of the lamp bulbs are each formed with a base sleeve, and the engagement surfaces are portions of the base sleeves. The depression or rises on the engagement surface are formed as steps; the rises or depressions in the socket terminals, respectively, are formed as ribs with positive elevation from the socket, or as depressed ribs therein. The steps, preferably, can be formed by milling locating surfaces of shallow depth in the engagement surface, for example in the bottom of the base sleeve. Such milled depressions or cuts can be easily formed; they do not decrease the overall diameter of the ends of the lamp within the holding region of the lamp, and do not change the overall length of the lamp, that is, the distance between engagement surfaces. Consequently, lamps with the base in accordance with the invention, can also be inserted in apparatus in which the sockets are conventional and are not shaped to engage with the surface abnormalities of the lamps in accordance with the invention.

In accordance with a preferred feature of the invention, the positioning arrangement is so located on the engagement surface and on the socket contacts, respectively, that the ends of the lamp bulb, and the terminals of the socket are point-symmetrical with respect to a center of the lamp. This means that the lamp can be inserted in the sockets in a given direction, or turned end for end. Such turning end for end is a 180° rotation of the lamp, and of the socket, if desired, about a rotational axis which extends perpendicular to the longitudinal axis of the lamp, and located between the socket terminals or, respectively, between the ends of the lamp bulb. Consequently, a first end of the lamp bulb, with a first base, may be coupled with a first socket terminal or, upon reversing the lamp end for end, a first base terminal of the lamp can be coupled to a second socket terminal, e.g., an engagement spring of the socket. This arrangement of the positioning surfaces has the advantage that both ends of the lamp bulb upon insertion into a socket have the same positioning value, which, in other words, means that they are positionally interchangeable. Some lamps are supplied with alternating current, so that the polarization of the lamp in the electrical sockets is immaterial. This arrangement is particularly advantageous in lamps designed for operation with alternating current, and in which the ends of the lamp bulbs are directly connected to bases without use of connection cables between the lamp and the socket, so that the sockets can be formed directly as electrical terminals. The arrangement for positioning of the lamps prevents, however, inserting the lamps in the socket formed with a pumping stub, facing downwardly, when it should face upwardly.

The engagement surfaces, and the surface abnormalities thereon, preferably are formed as components of the metallic base sleeves secured to the ends of the lamp bulbs. The base sleeves and the socket terminals then not only hold the lamp in position, but also form electrical terminals to both ends of the double-based electric lamp.

DRAWINGS

DETAILED DESCRIPTION

Figure 1:
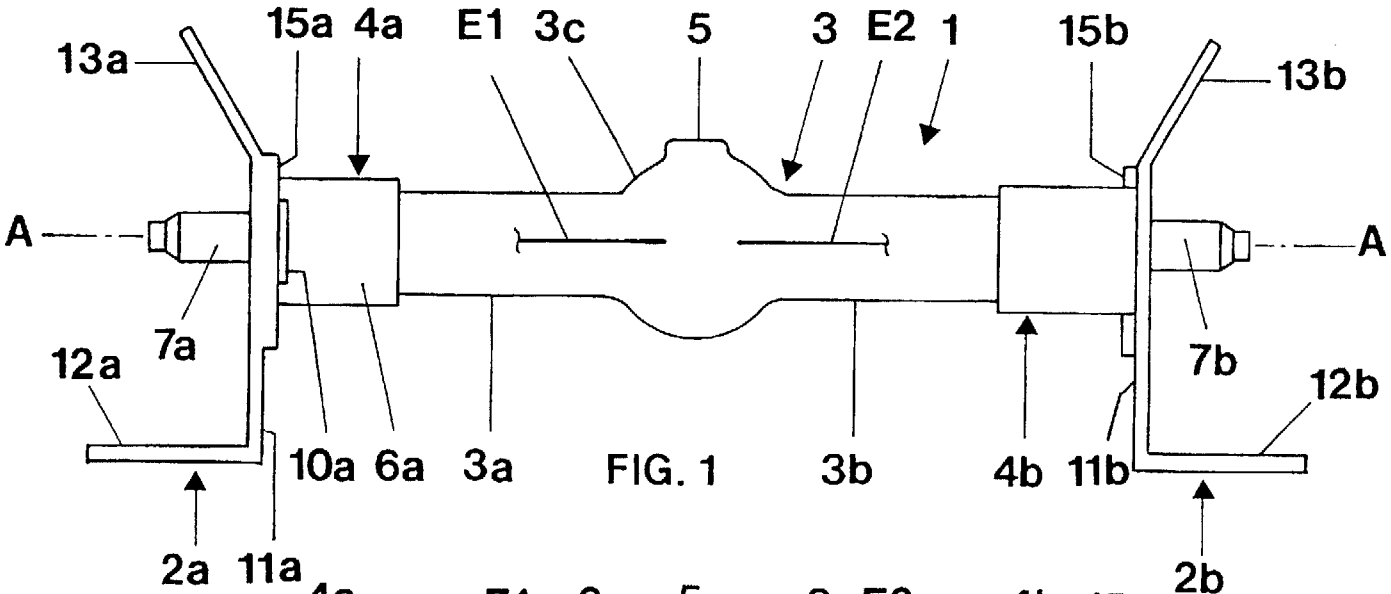
FIG. 1 is a highly schematic side view of the double-based electric lamp installed in a socket, in accordance with a preferred embodiment of the invention, in which the preferred position of the lamp includes a pumping stub pointing upwardly.

FIG. 1 shows, highly schematically, a double-ended, double-based high-pressure discharge lamp 1, located in a socket, and illustrating a preferred embodiment. For purposes of explanation, the lamp is shown as a 575 W metal halide high-pressure discharge lamp, intended to be supplied with alternating current. The socket terminals or socket contacts 2*a*, 2*b* of the lamp socket can be integrated, for example, with a video projector, or an overhead projector.

The lamp 1 has a lamp bulb 3 of quartz glass, with two ends 3*a*, 3*b* located at both sides of the discharge space 3*c*. The ends extend along the longitudinal axis A—A of the lamp 1. In this embodiment, the lamp bulb 3 also forms the discharge vessel of the lamp 1, and is identical therewith. The ends 3*a*, 3*b* of the lamp bulb or, in the embodiment shown also of the discharge vessel, are formed as shaft-like extensions which have molybdenum foils gas-tightly sealed therein, and electrically connected to lamp electrodes E1, E2 shown only schematically. The molybdenum foils form electrical energy connections to the electrodes E1, E2 within the discharge space 3*c* of the bulb. A gas discharge will form between the electrodes E1, E2 in operation of the lamp. The shafts are terminated at their free ends by respective metallic base sleeves 4*a*, 4*b* fitted on the bulb ends 3*a*, 3*b*. The base sleeves 4*a*, 4*b* are electrically conductively connected to the molybdenum foils, as well known in constructions of lamps of this type.

The lamp bulb 3 is rotation symmetrical with respect to the longitudinal axis A—A in the region of the shaft extensions 3*a*, 3*b*. In the region of the discharge space 3*c*, the rotational symmetry of the bulb 3 is interfered with by the tipped-off exhaust and fill stub 5.

The high-pressure discharge lamp 1 is operated in horizontal direction, that means that the discharge arc between the electrodes E1, E2 extends in horizontal direction. During lamp operation, the bulb 3 must be so oriented, that the tipped-off stub 5 points in a specific direction, typically upwardly.

Figure 3:
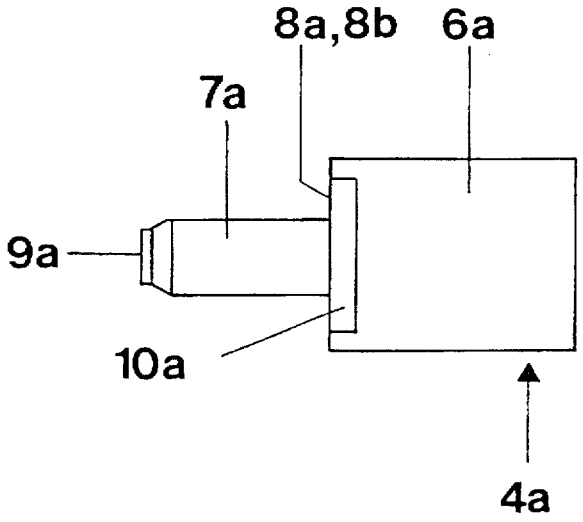
FIG. 3 is a highly schematic side view of a preferred embodiment of the base sleeve for use with the lamp of the invention.

In accordance with a feature of the invention and to insure that the lamp is always appropriately oriented in its socket, the essentially rotation-symmetrical, cylindrical base sleeves 4*a*, 4*b* are formed with positioning surfaces which are matched to appropriate positioning regions or surfaces of the socket terminals 2*a*, 2*b*. The metallic base sleeves 4*a*, 4*b* are formed with two adjacent portions 6*a*, 7*a*; 6*b*, 7*b* (see specifically FIG. 3) of respectively different diameters. The two portions 6*a*, 6*b* and 7*a*, 7*b*, respectively, of any one of the base sleeves 4*a*, 4*b*, define an engagement surface 8*a*, 8*b* extending perpendicularly with respect to the longitudinal axis A—A of the lamp, and which is of circular, ring-shaped configuration. The first portion 6*a*, 6*b*, respectively, of the base sleeves 4*a*, 4*b*, respectively, has a larger diameter than the second portion 7*a*, 7*b*. The free end of the respective shaft 3*a*, 3*b* of the bulb 3 is secured in the first portion 6*a*, 6*b* of the base sleeves 4*a*, 4*b*. The open end of the second, and tubular portion 7*a*, 7*b* is closed by a metallic base pin 9*a*, 9*b*.

In accordance with a feature of the invention, the engagement surfaces 8*a*, 8*b* of the base sleeves 4*a*, 4*b* are formed with a surface abnormality. In the embodiment shown, the abnormalities are recesses 10*a*, 10*b* (see specifically FIGS. 3 and 4) formed, for example, by a milling cut. The depth of the recess is, for example, about 1.5 mm. These recesses 10a, 10b define, respectively, a step in the engagement surfaces 8a, 8b having an edge 20 which extends at a straight line and perpendicularly to the longitudinal axis A—A of the lamp. The depth of this milling cut 10a, 10b is less than the wall thickness of the base sleeves 4a, 4b in the region of the engagement surfaces 8a, 8b. The base sleeves 4a, 4b are identically shaped.

The socket terminals 2a, 2b also are identically shaped. They are made of metal and, essentially, are shaped in angular, or bracket form. The socket terminals 2a, 2b have contact surfaces 11a, 11b, as well as a leg portion 12a, 12b bent off from the contact surface 11a, 11b. An inclined portion 13a, 13b extends from the upper edge of the contact regions 11a, 11b. The contact regions 11a, 11b of the socket terminals 2a, 2b are formed with a slit-like opening 14a, 14b, which extends from the contact surface 11a, 11b into the inclined portion 13a, 13b.

In accordance with a feature of the invention, the socket terminals 2a, 2b have a surface abnormality, which matches the recess 10a, 10b of the base, in form of a rib, or ridge, or projection 15a, 15b. The projection 15a, 15b, which projects from the contact surface 11a, 11b, respectively, extends parallel to the opening 14a, 14b. The width of the openings 14a, 14b is matched to the diameter of the second, tubular portion 7a, 7b of the base sleeves 4a, 4b. The socket terminals 2a, 2b provide electrical energy supplied to the lamp 1. The electrical contact is effected over the contact surfaces 11a, 11b of the socket terminals 2a, 2b engaging the engagement surfaces 8a, 8b of the base sleeves 4a, 4b. The base sleeves 4a, 4b here are electrical terminals, as well as mechanical attachment elements, without use of additional connecting wires or cables between the lamp and the socket, and provide the electrical connection and mechanical retention of the lamp 1.

Insertion and positioning of the lamp 1 in a socket

Upon inserting lamp 1 in a socket having the terminals 2a, 2b, the second portion 7a, 7b of the base sleeves 4a, 4b engage through the openings 14a, 14b of the socket terminals 2a, 2b, so that the contact surfaces of the contact portions 11a, 11b of the socket terminals 2a, 2b can engage against the engagement surfaces 8a, 8b of the base sleeves 4a, 4b, and clamp the lamp in position. The rib-like projections 15a, 15b of the socket terminals 2a, 2b engage in the recesses 10a, 10b of the base sleeves 4a, 4b. The cut-outs or recesses 10a, 10b and the rib-like projections, 15a, 15b insure, in combination with the reception of the lamp bulb ends 7a, 7b within the openings 14a, 14b, that the lamp 1 can be inserted in the socket terminals 2a, 2b only when the pump stub 5 faces upwardly. If it is attempted to insert the lamp with the pump stub 5 facing downwardly, or laterally, for example, the rib-like projections 15a , 15b prevent introduction of the base sleeve portions 7a, 7b in the reception openings 14a, 14 b of the socket terminals 2a, 2b.

The ends 3a, 3b of the lamp bulb 3, and the socket terminals 2a, 2b with the positioning surface abnormalities 10a, 10b; 15a, 15b, respectively, are point-symmetrical with respect to a theoretical center of the lamp. The theoretical center of the lamp is in the middle between the ends 3a, 3b or, respectively, between the socket terminals 2a, 2b and on the longitudinal lamp axis A—A . Consequently, the lamp bulb ends 3a, 3b, with their bases attached, and the socket terminals 2a, 2b can be brought into congruence upon rotation of the lamp 1 and of the socket about 180° about a suitable axis of rotation, which extends perpendicular to the longitudinal axis A—A and is located centrally between the socket terminals 2a, 2b. Upon such rotation, the first end 4a is brought into congruence with the second base end 4b, and the first socket spring or terminal 2a is brought into congruence with the second socket spring 2b and, especially, with the respective surface abnormalities, 15a of the first socket element 2a and the surface abnormality 15b of the second socket spring 2b, as well as the surface abnormality 10a of the first end 4a of the bulb and the second surface abnormality 10b of the second lamp end sleeve 4b. This is possible because both ends of the lamp bulb 3a, 3b are of equal positioning value. Thus, the lamp 1, upon installation, can be so oriented that the end 4a of the lamp bulb is placed either in the reception opening 14a of the socket spring 2a, or in the reception opening 14b of the socket terminal 2b. The surface abnormalities 10a, 10b; 15a, 15b then will insure that the lamp can be inserted exclusively in a position in the socket, such that the stub or tip 5 extends upwardly.

The positioning abnormalities 10a, 10b; 15a, 15b do not change the spacing or dimension of the engagement surfaces 8a, 8b from each other, and do not change the diameter of the base sleeves 4a, 4b within the holding region of the lamp 1 and, more specifically, within the second tubular portion 7a, 7b of the base sleeves 4a, 4b which engages in the openings 14a, 14b of the socket terminals 2a, 2b. Thus, the lamp in accordance with the invention can be used also in optical apparatus which have different sockets, and different socket arrangements, without any specific surface abnormalities which prevent insertion of the lamp in the socket in other than a preferred position.

Figure 2:
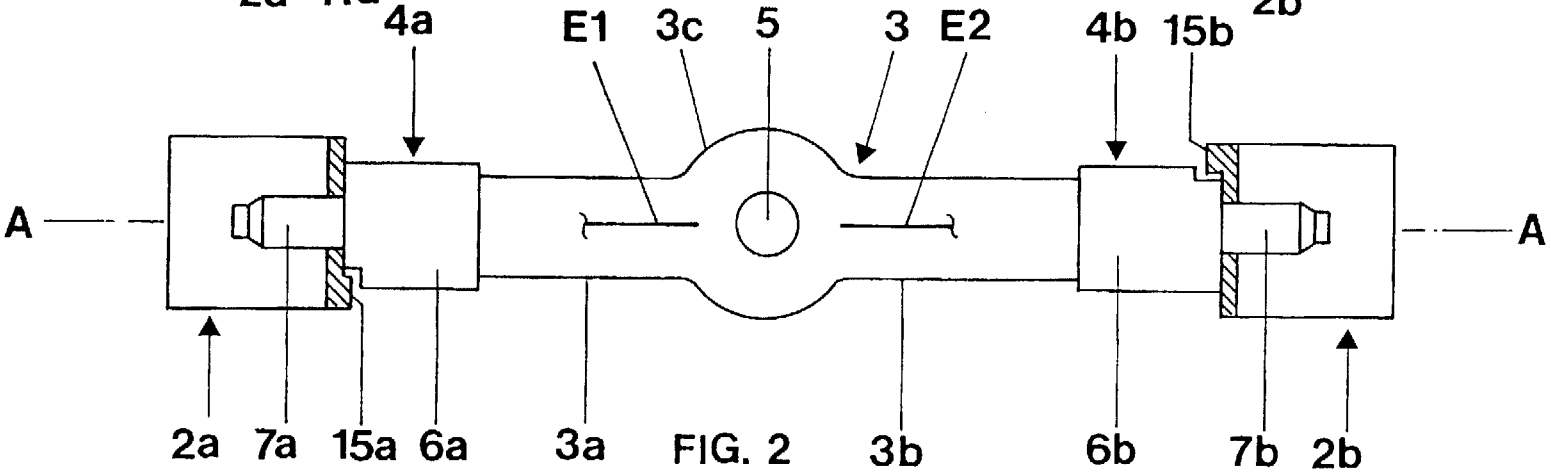
FIG. 2 is a highly schematic side view of the lamp and socket of FIG. 1, rotated 90° with respect to FIG. 1, and in which the socket is shown partly in section.
Figure 6:
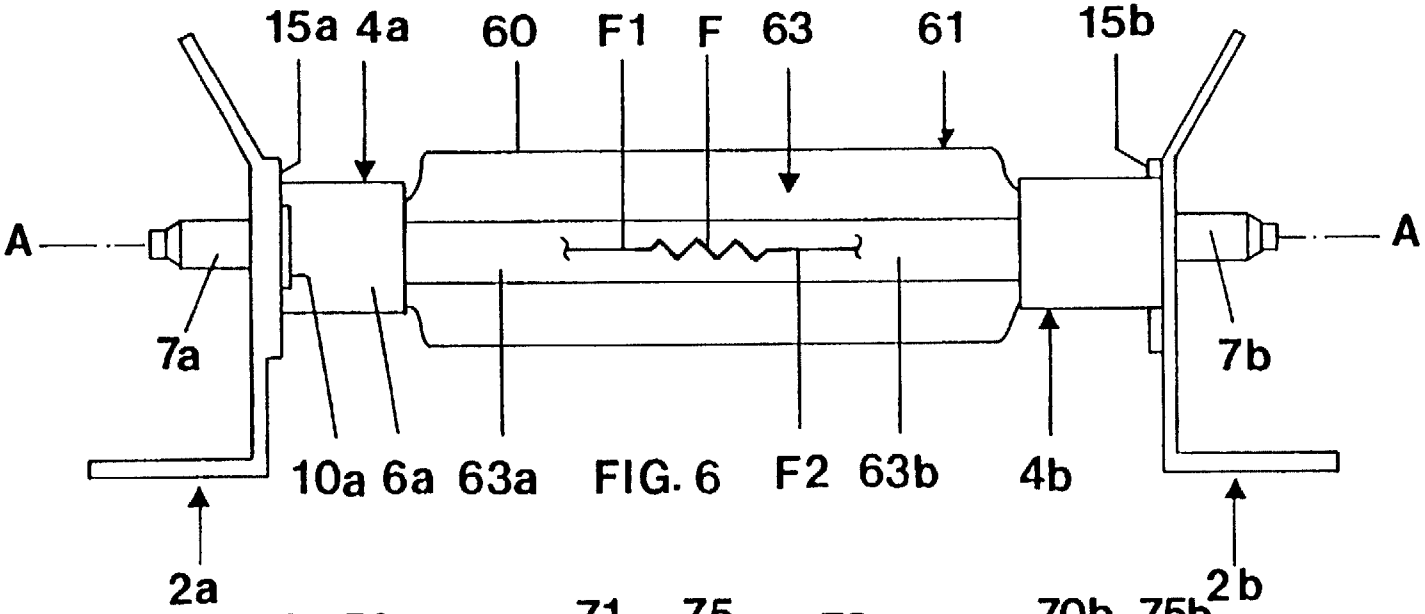
FIG. 6 is a highly schematic side view of a lamp with an outer surrounding bulb.

Various changes and modifications may be made within the scope of the present invention. For example, the lamp may be a high-pressure discharge lamp (FIGS. 1 and 2) in which the discharge vessel 3 of the lamp is surrounded by a double-ended outer bulb 60. FIG. 6. FIG. 6 also illustrates another light source F, shown, for purposes of illustration, as a filament having electrode terminals F1 and F2 enclosed within a bulb 63. The lamp 61, regardless of the light source, has an outer bulb 60 surrounding the inner bulb 63. The space between the inner bulb and the outer bulb is, for example, evacuated or filled with an inert gas. FIG. 6 shows the lamp to be a tubular incandescent lamp. The radial asymmetry of the lamp need not be due to an exhaust or pumping tip but, for example, could be due to any asymmetries causing optical disturbances, for example a non-symmetrical position of the light source, shown in FIG. 6 highly exaggerated, as a non-symmetrical position of the ends 63a and 63b of the inner bulb 63 within the socket sleeves 4a, 4b. In such an arrangement, the inner bulb as well as the end portions 63a, 63b of the inner bulb are non-symmetrically located. If an exhaust stub is provided, it can be located also in positions different from those shown in FIGS. 1 and 2, for example at the side, in which case, for such an optical arrangement, the sleeves 4a, 4b can merely be rotated, before being secured to the ends of the lamp bulb 3a, 3b.

Figure 7:
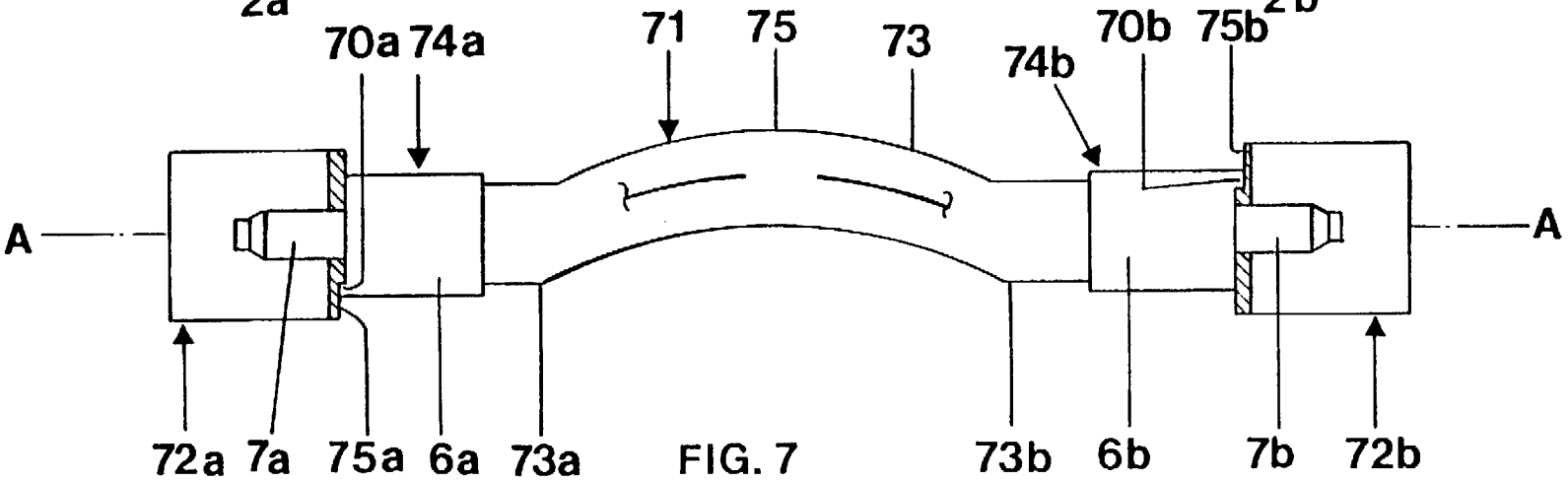
FIG. 7 illustrates another form of lamp and having the base structure in accordance with the present invention.

Some lamps have a discharge vessel in which the asymmetry is formed by a bend FIG. 7 illustrates a discharge vessel 73 which is bent or bowed, and in which, also, a predetermined operating position is required to insure cooperation of fit in an apparatus and/or a specific association with an optical system. FIG. 7 illustrates a sickle-shaped discharge vessel 73, having end portions 73a, 73b which are fitted into base sleeves 4a, 4b. The apex 75 of the sickle-shaped discharge vessel 73 is, of course, rotationally unsymmetrical with respect to the base sleeves 4a, 4b, and if the operating position of the lamp is to be predetermined, the bases 4a, 4b and, preferably, the matching socket terminals 2a, 2b include the positioning arrangement, or combination 10a, 10b; 15a, 15b. The angled-off ends 13a, 13b of the socket terminals may be used, for example, as engagement tabs, if the lamp is to be released from the socket terminals, by bending the socket terminals away from the center of the lamp.

Figure 4:
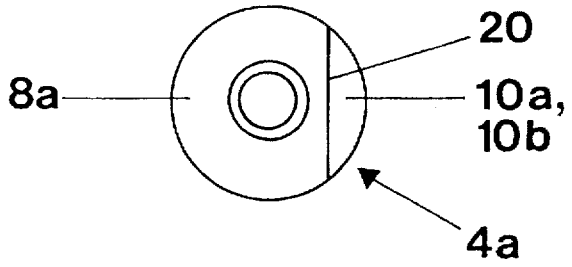
FIG. 4 is a schematic top view of the base sleeve, omitting elements not needed for an understanding of the invention.
Figure 5:
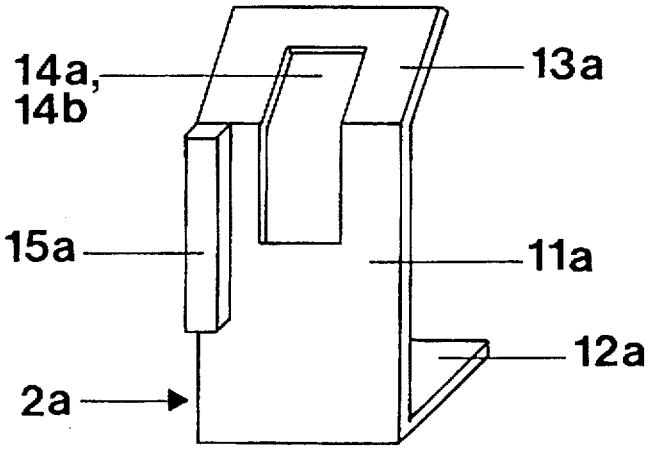
FIG. 5 is a schematic isometric front view of a lamp socket spring and illustrating a surface abnormality in form of a raised rib.

The surface abnormalities shown in FIGS. 4 and 5 are illustrated in the form of a descending step in FIG. 4, and an ascending step in FIG. 5, formed on the socket terminal 2a. The step arrangement can, of course, also be reversed. FIG. 7 illustrates an ascending step 70a, 70b formed on the base sleeves 74a, 74b, to fit into matching recesses 75a, 75b of the socket terminals 72a, 72b.

Various other changes and modifications may be made, and any features described herein in connection with any one of the illustrated, or described examples may be used with any of the others, within the scope of the inventive concept. Of course, lamps which have one socket terminal and one cable terminal, and which are intended for placement in a specific operating position, can be equipped with one of the bases in accordance with the present invention, to be inserted into the respective socket, which has the interfitting or interengaging surface abnormality to match the base.

We claim:

1. A double-based lamp (1) having a preferred operating position, and defining a lamp axis (A—A), comprising the combination of a light source including a lamp bulb (3, 63, 73);

at least one base (4a, 4b) secured to one end portion of the lamp;

said lamp bulb (3, 63, 73) being radially non-symmetrical with respect to said axis (A—A) and forming a radial asymmetry, said radial asymmetry defining said preferred operating position;

two end portions (3a, 3b; 63a, 63b; 73a, 73b) extending from the lamp bulb along said axis (A—A); and light emitting means (E1, E2; F) within said bulb said at least one base (4a, 4b) being secured to an end portion of the lamp bulb and having a first rotation-symmetrical portion; and wherein, in accordance with the invention, means are provided for determining said preferred operating position of the lamp, said preferred position determining means including a surface abnormality (10a, 10b) formed on said at least one base (4a, 4b), located non-rotation symmetrically with respect to said axis (A) on a second other portion of said at least one base, and in predetermined relative position with respect to said radial asymmetry of the bulb.

2. The lamp of claim 1, wherein two bases (4a, 4b) are provided and both bases are formed with said surface abnormality.

3. The lamp of claim 1, wherein said surface abnormality comprises at least one of: a rise, or projection extending from said second other portion of said at least one base; a depression, or recess extending from said second other portion of said at least one base.

4. The lamp of claim 2, wherein said surface abnormalities (10a, 10b) on the respective bases (4a, 4b) are so shaped and positioned that, upon rotation of the lamp over 180° about an axis of rotation extending perpendicularly to said lamp axis (A—A) and centrally between the end portions (3a, 3b) of the lamp, said surface abnormalities will be congruent with their positions before such rotation.

5. The lamp of claim 1, wherein said at least one base formed with the surface abnormality (10a, 10b) comprises an essentially rotational-symmetrical base sleeve (4a, 4b) positioned rotation-symmetrically with respect to said lamp axis;

an engagement surface (8a, 8b) formed on the base sleeve and extending perpendicularly to the lamp axis (A—A); and wherein said surface abnormality comprises a recess, or cutout formed in the respective engagement surface (8a, 8b) shaped and positioned on said surface to destroy the rotation symmetry of the respective base sleeve at said recess.

6. The lamp of claim 2, wherein each base comprises an essentially rotational-symmetrical base sleeve (4a, 4b) positioned rotation-symmetrically with respect to said lamp axis;

an engagement surface (8a, 8b ) formed on the base sleeve and extending perpendicularly to the lamp axis (A—A); and wherein said surface abnormality comprises a recess, or cut-out formed in the respective engagement surface (8a, 8b ) shaped and positioned on said surface to destroy the rotation symmetry of the respective base sleeve at said recess;

and wherein the recesses (10a, 10b) on the two base sleeves (4a, 4b) with their recesses (10a, 10b) therein, are so positioned that, upon rotation of the lamp (1) by 180° about a rotation axis extending perpendicularly to the longitudinal axis (A—A) and positioned centrally between the two base sleeves (4a, 4b), the position of the base sleeves (4a, 4b) will be congruent, or identical to the position prior to said rotation.

7. The lamp of claim 5, wherein said lamp is an alternating current operated lamp; and wherein said at least one lamp base (4a, 4b) comprises an electrical terminal adapted for connection to an electrical energy supply socket.

8. The lamp of claim 5, wherein the lamp (1) comprises a discharge lamp, and the lamp bulb (3) forms the discharge vessel for the lamp (1).

9. The lamp of claim 5, wherein the lamp is a discharge lamp and includes an inner discharge vessel forming an inner bulb (63), and supplied with electrodes and forming said light-emitting means, and an outer surrounding bulb (60) surrounding said discharge vessel, said outer surrounding bulb forming said lamp bulb, both of said bulbs forming said light source.

10. The lamp of claim 9, wherein the radial asymmetry comprises a radial offset of the inner bulb with respect to said lamp axis (A—A) within said outer bulb (60), and parallel to said lamp axis.

11. The lamp of claim 5, wherein said light source comprises a discharge lamp having a discharge vessel (73) and said radial asymmetry comprises a bend in said discharge vessel (73).

12. The lamp of claim 1, wherein said light emitting means comprises an incandescent lamp filament (F).

13. The lamp of claim 1, wherein said radial asymmetry comprises a pumping stub or tip (5) formed on said lamp bulb (3, 60, 63) positioned radially spaced from said lamp axis (A—A).

14. The lamp of claim 1, in combination with at least one socket terminal (2a, 2b), said socket terminal being shaped, configured and dimensioned to receive at least one lamp base (4a, 4b) of said lamp (1, 61, 71), said at least one lamp base (4a, 4b) having engagement surfaces (8a, 8b) extending perpendicularly with respect to said lamp axis (A—A); and wherein said at least one socket terminal includes a base reception region, and is formed with a socket surface abnormality (15a, 15b) which is shaped, configured and dimensioned to interengage with said socket surface abnormality formed on said at least one of said bases (4a, 4b) of the lamp (1, 61, 71), whereby, upon insertion of the lamp in the reception region (14a, 14b) of the at least one socket terminal (2a, 2b), the respective surface abnormality (10a, 10b) on the respective lamp base will interengage with the socket surface abnormality (15a , 15b) and thus determine said preferred operating position of the lamp.

15. The combination of claim 14, wherein both end portions of the lamp each are supplied with a respective lamp base (4a, 4b);

two socket terminals (2a, 2b) are provided;

the engagement surfaces (8a, 8b) formed on the lamp bases are part of the lamp bases;

the surface abnormalities on the lamp bases comprise at least one of: a projection extending from said engagement surface; a depression receding from said engagement surface, and each surface abnormality defining a step with respect to the remainder of the engagement surface;

and wherein the socket surface abnormalities of the socket terminals (2a, 2b) are formed as matching depressions or cut-outs, outs, or projections, respectively, in step form, matching and interengaging with the respective surface abnormality of the engagement surface (8a, 8b) of the respective lamp bases (4a, 4b); and wherein said reception regions on said socket terminals comprise reception portions (14a, 14b) to receive at least part (7a, 7b) of said lamp bases (4a, 4b), whereby, upon inserting the end portions (3a, 3b) of the lamp into the reception portions (14a, 14b) of the socket terminals (2a, 2b), descending or ascending steps (10a, 10b) on the lamp bases (4a, 4b) will interengage with said projections and said depressions formed on the socket terminals and thus guide the lamp into said preferred operating position.

16. The lamp of claim 15, wherein the end portions (3a, 3b) of the lamp, and the socket terminals (2a, 2b) are point-symmetrical with respect to a central position of said lamp axis (A—A) in said lamp bulb (3, 63, 73)

whereby, upon rotation of the lamp and of the socket terminals about 180° and about an axis of rotation which is perpendicular to said lamp axis (A—A) and located centrally between the socket terminals (2a, 2b), the first bulb end portion (3a) will be interchangeable with the second bulb end portion (3b) and the first socket terminal (2a) will be interchangeable with the second socket terminal (2b) and the surface abnormality, (15a) of the first socket terminal (2a) will be interchangeable with the surface abnormality (15b) of the second socket terminal and the surface abnormality (10a) of a first lamp base will be interchangeable with the surface abnormality (10b) of a second lamp base (4b) at the other end of the lamp.

17. The lamp of claim 15, wherein the surface abnormalities (10a, 10b) formed in the engagement surfaces (8a, 8b) of the lamp bases (4a, 4b) have a dimension above or below said engagement surface which is less than the wall of thickness of the lamp base at the respective engagement surface.

18. The lamp of claim 14, wherein the lamp bases (4a, 4b), and the socket terminals (2a, 2b) are all made of metal.

19. The combination of a lamp (1) having a lamp bulb, and at least one essentially tubular end portion (3a, 3b), extending from said bulb with an essentially rotation-symmetrical base sleeve (4a, 4b), and defining an axis of rotation (A—A) adapted to fit on said end portion, said base sleeve (4a, 4b) having an engagement surface (8a, 8b) extending essentially perpendicularly to the axis of rotation and wherein, in accordance with the invention, the surface of said engagement surface (8a, 8b) is formed with a surface abnormality (10a, 10b) which destroys the rotation symmetry of the base sleeve (4a, 4b).

20. The combination of claim 19, wherein said surface abnormality comprises a stepped recess (10a, 10b) formed in said engagement surface (8a, 8b), extending perpendicularly to said axis of rotation, and being radially offset therefrom.

21. The combination of claim 20, wherein said stepped recess (10a, 10b) has a depth which is less than the wall thickness of the base sleeve (4a, 4b) in the region of the engagement surface (8a, 8b) extending perpendicularly to said axis of rotation (A—A).

* * * * *